United States Patent [19]

Normantas

[11] 4,029,026

[45] June 14, 1977

[54] INCINERATOR

[76] Inventor: Liudas Normantas, Hiram, Maine 04041

[22] Filed: Mar. 18, 1976

[21] Appl. No.: 629,758

[52] U.S. Cl. ..... 110/8 A; 110/18 R; 110/109

[51] Int. Cl.[2] ..... F23G 5/00

[58] Field of Search ..... 110/8 R, 8 A, 11, 18 R, 110/7 R, 40 R, 109

[56] References Cited

UNITED STATES PATENTS

| | | | |
|---|---|---|---|
| 3,362,887 | 1/1968 | Rodgers | 110/11 |
| 3,745,941 | 7/1973 | Reilly | 110/8 |
| 3,757,708 | 9/1973 | Prospero | 110/8 |
| 3,785,306 | 1/1974 | Jaget | 110/11 |
| 3,964,406 | 6/1976 | Partridge | 110/40 |

*Primary Examiner*—Kenneth W. Sprague
*Attorney, Agent, or Firm*—James J. Cannon, Jr.

[57] ABSTRACT

An improved, pollution-free incinerator eliminating the need for a conventional, independently-fired afterburner, having a loading chamber in which slow combustion commences, hydraulic means to move waste materials through said loading chamber to a two-section primary combustion chamber, said loading chamber being in communication with the lower portion of said primary combustion chamber to utilize gases generated from the initial slow combustion area to fire said primary combustion chamber and to burn the gases generated therein, and air baffle to filter particulate matter which might escape from said primary combustion chamber, and hydraulic means to remove ash from said incinerator.

7 Claims, 5 Drawing Figures

INCINERATOR

FIELD OF THE INVENTION

This invention pertains to pollution-free incinerators, and, in particular, to incinerators in which slow, starved oxygen combustion is commenced at the base the loading chamber, the need for an independently-fired after-burner is eliminated and the practical effects of an after-burner are achieved within the primary combustion chamber itself combined with air baffles.

DESCRIPTION OF THE PRIOR ART

Recent U.S. Pat. Nos. 3,855,950 and 3,881,431 describe the recent prior art in pollution-free starved oxygen incinerator design. These designs both are very effective but necessitate the use of an after-burner to complete the combustion process by burning the gases and particulate matter which rise from the primary combustion chamber into said after-burner. Such after-burners require an independent source of fuel, such as propane, natural gas or the like. This, in turn, increases the operating cost of such incinerators and causes a potential waste of energy.

The incinerator of the present disclosure through its novel design, provides a means to utilize the gases generated by the initial slow combustion, primarily methane, to fuel the lower portion of the primary combustion chamber, thus causing nearly complete combustion of the particulate matter and gases produced in the primary combustion chamber, eliminating the need for an independently fueled after-burner and its consequent cost. It provides for an air baffle to cool the carbon dioxide and water vapors which are produced while also catching any particulate matter which should escape from the primary combustion chamber.

The incinerator of this invention is intended to be an improved and simplified type of incinerator in comparison with prior art. It is also suitable as a component in an efficient heating and steam generating plant.

SUMMARY OF THE INVENTION

The pollution-free incinerator of the present invention includes a loading hopper and loading chute into which rubbish, garbage and other waste materials are deposited and moved by a pushing mechanism to a loading chamber in which they are deposited onto moving trays on a set of parallel tracks which pass under said loading chamber. Said loading chamber is located physically adjacent to the primary combustion chamber, and its base is in communication therewith by means of an opening on the connecting wall and by other means described hereinafter. The heat generated from the primary combustion chamber dries the rubbish, garbage and other waste materials in the loading chamber and causes a preliminary, slow combustion of materials in the loading chamber, causing a non-turbulent slow, starved oxygen combustion. The initial by-product of this combustion is methane gas which is forced to flow into the lower portion of the primary combustion chamber. After the commencement of combustion in the loading chamber, the trays are gradually pushed to move the waste materials into the primary combustion chamber in which they are intensely burned at high temperatures as they flow through to the opposite end. The primary combustion chamber comprises two elongated, inverted U-shaped structures, one higher, wider and shorter than the other, referred to as the upper section of the primary combustion chamber and positioned above and extended slightly beyond the lower, smaller and longer of said structures, referred to as the lower section of the primary combustion chamber. The tray and track system moves waste materials in through said smaller, longer U-shaped structure in which the waste materials are burned under intense heat, the heat intensifying as the materials move through to the end. The rounded roofs of said sections of said primary combustion chamber, all of which are fabricated from high temperature fire brick (refractory brick) cause the rising heat to be reflected downward to further intensify the heat within said sections of said primary combustion chamber. The intense heat near the roof of said lower section causes the rising gases and particulate matter (ash) to burn as completely as possible. The gases and unburned particulate matter gradually rise as the trays move to the end of the longer and smaller inverted U-shaped structure serving as the lower section of the primary combustion chamber, at which end they rise while still burning into the upper section of said chamber and are fully burned as they reach the convex area between the two inverted U-shaped structures. This upper section is not fueled. The methane gas generated in the loading chamber is used in the burning of waste materials in the lower section of the primary combustion chamber, producing intense heat which serves to burn all gases and pariculate matter rising from the lower portion of the primary combustion chamber as well as to produce an intense heat which accelerates combustion in the lower section of the primary combustion chamber. The only means for any vapor and unburned particulate matter to escape from the primary combustion chamber is through an air baffle which cools the gases, now reduced principally to carbon dioxide and water vapor, and which collects the few particles of particulate matter which might escape the primary combustion chamber. The remaining cooled, non-polluting vapors then rise through a traditional stack.

DESCRIPTION OF THE EMBODIMENT

Figure 1:
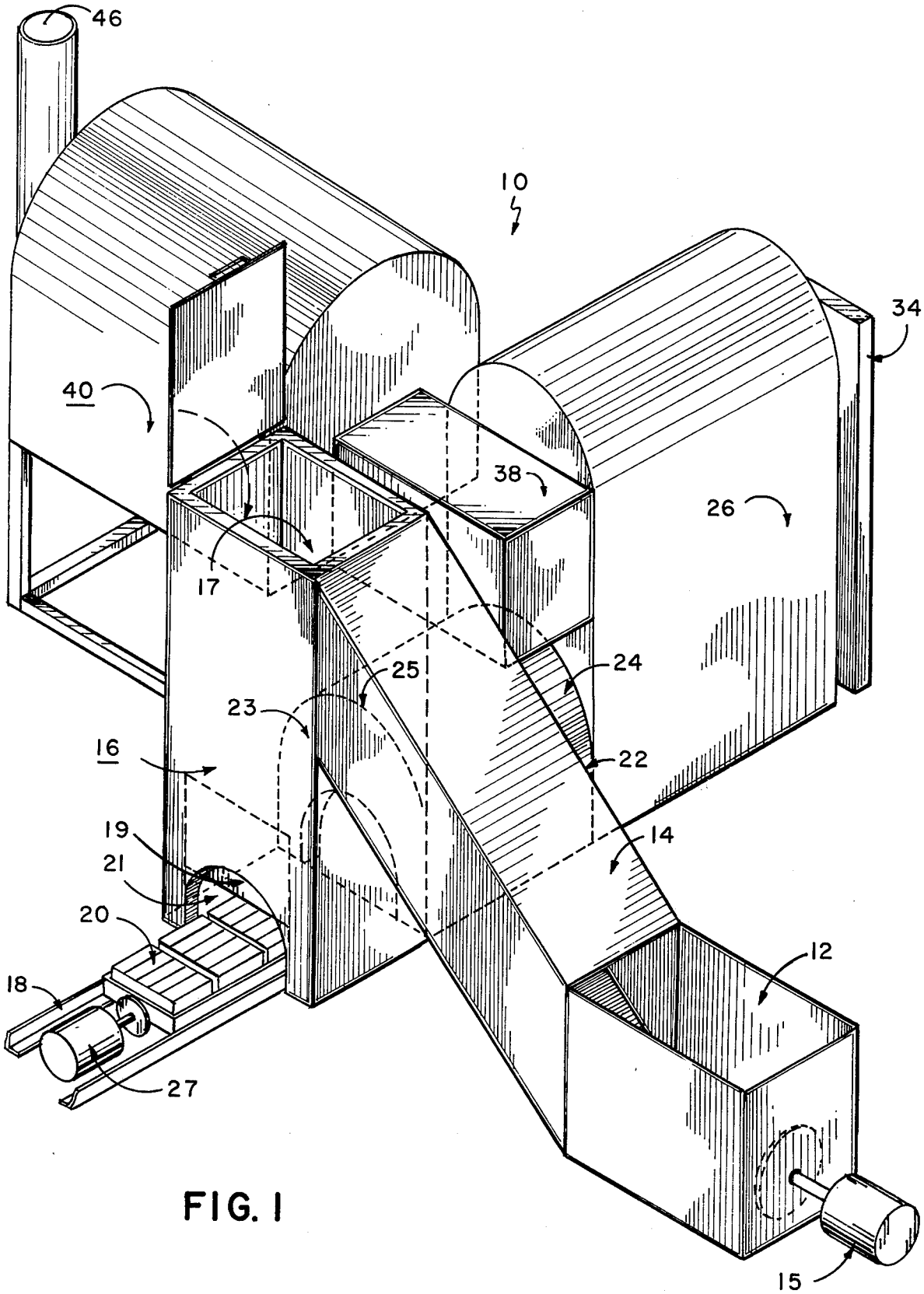
FIG. 1 is a perspective view of the improved pollution-free incinerator of the present invention.

Referring now to the drawings, and in particular, to FIG. 1, wherein is shown a perspective view of the incinerator of the present invention, incinerator 10 includes a loading hopper 12 in which rubbish, garbage, waste materials of other materials which can be incinerated are placed. Said waste materials are conveyed through chute 14 by any conventional pushing means such as a hydraulically driven ram 15 or any other conveyance means, which include gravity if hopper 12 is higher than chute 14. From chute 14 said waste materials fall into loading chamber 16 which is tightly closed at its top 17. waste materials may accumulate in loading chamber 16.

At the base of loading chamber 16 the materials to be burned fall into trays 20 which ride on a set of tracks 18, conveying tray loads of waste materials into primary combustion chamber 22 through opening 23. Opening 23, at the base of loading chamber 16, is effectively an opening in the side wall of primary combustion chamber 22 and permits heat, gases and waste materials to pass between loading chamber 16 and primary combustion chamber 22. Tray movement tracks 18 located beneath loading chamber 16 receive trays 20 and move a portion of the waste material accumulated in loading chamber 16 into the primary combustion chamber 22 which is physically adjacent to said loading chamber 16, and in communication therewith through opening 23. Since the base of loading chamber 16 is in direct communication with primary chamber 22 a slow, starved oxygen combustion will be initiated therein. This initial, slow combustion will produce some flammable gases such as methane. Since the gases cannot escape upwards through loading chamber 16 they will pass into primary combustion chamber 22 serving to fuel the fire therein and in which they will be completely burned. Oxygen (air) is allowed to enter only through the loading chamber 16 and entrance portal 21. The passage of air through the loading chamber 16 is limited by accumulated waste or a device to close the access through the chute 14. The passage of air through the entrance portal 21 is controlled by a damper mechanism.

Figure 5:
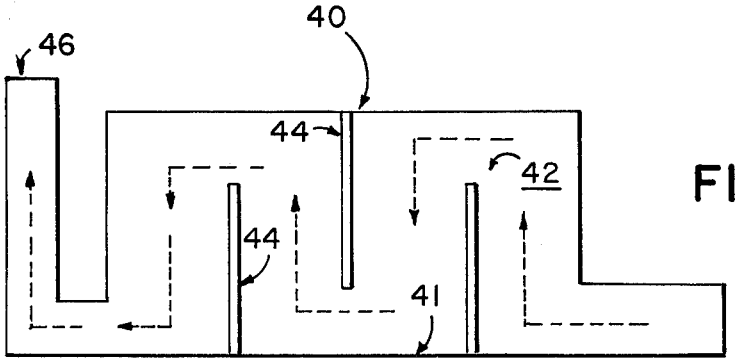
FIG. 5 is a cross-sectional view of the air baffle of the incinerator of FIG. 1 taken along the line 5—5 of FIG. 4.
Figure 3:
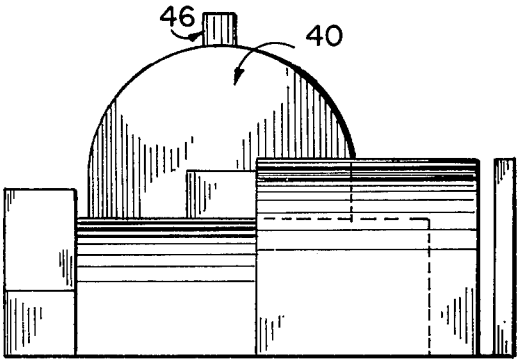
FIG. 3 is a front view of the incinerator of FIG. 1.
Figure 4:
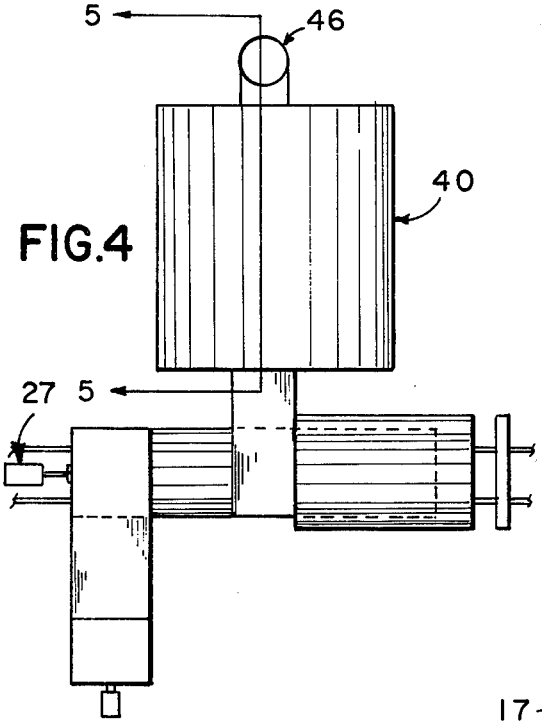
FIG. 4 is a top view of the incinerator of FIG. 1.
Figure 2:
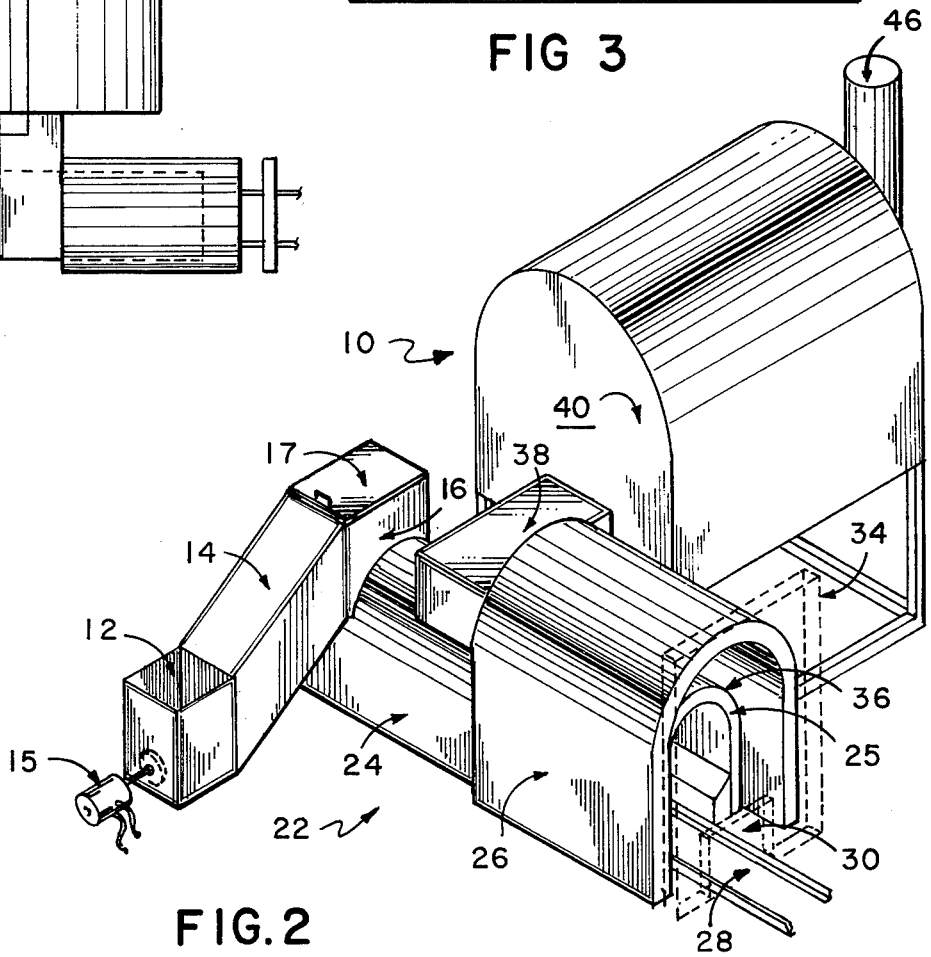
FIG. 2 is another perspective view of the incinerator of FIG. 1.

Said primary combustion chamber 22 includes two inverted U-shaped structures (FIG. 2), 24, 26, of which the smaller, lower and longer structure 24 serves as the lower section thereof and the larger, shorter and higher structure 26 serves as the upper section thereof. As trays 20 are moved along tracks 18, they carry waste materials through the lower section 24 of primary combustion chamber 22 and intense fire develops, fueled by the gases generated from the initial slow combustion. This fire becomes more intense as the trays of waste materials proceed through said lower chamber 24. As heat intensifies, a turbulent fire is generated within said lower section 24 of primary combustion chamber 22; however, said turbulent currents of ash and gases are forced by the curved roof 25 thereof back down to further fuel said combustion. Thus, the intense heat generated along the length of primary combustion chamber 22 causes virtually complete combustion of waste materials, particulate matter and gases thereon. The bulk of said waste materials is consumed and trays 20 deliver only a small residue of ash out through exit 28. The intense heat in the lower section 24 of primary combustion chamber 22 adjacent to loading chamber 16 causes the waste materials in loading chamber 16 to ignite and combust slowly. The product of this initial slow combustion is primarily methane gas which is allowed to escape through opening 23 into the top of the lower section 24 of primary combustion chamber 22. Primary combustion chamber 22 ends at wall 34 which is tightly closed against structure 26; however, its lower section 24 terminates some distance from wall 34 as illustrated in FIG. 2 and FIG. 1 in outline. This permits gases and particulate matter not completely burned in the lower section 24 to rise while burning into upper section 26 in which combustion is completed and the flames extinguished. Thus, upper section 26, serves as a means to terminate combustion; and the burning therein of the gases and particulate matter arising from lower section 24 is rapid, complete and produces a very intense heat. This heat, in turn, causes the upper convex surface 36 of lower section 24 of primary combustion chamber 22 to become very hot, thereby retaining heat in lower section 24. As hot gases and particulate matter proceed to wall 34 of primary combustion chamber 22, they rise to upper section 26 of said chamber 22 and reverse their path over through said upper chamber 26 causing nearly complete combustion of gases and particulate matter. The by-products of said combustion in the upper section 26 of primary combustion chamber 22 are primarily carbon dioxide and water vapor, with a small mixture of incompletely combusted particulate matter. These by-products proceed through collection chamber 38 into air baffle 40 for cooling and depositing of particulate matter. Air baffle 40 (FIG. 5) comprises a large, relatively uninsulated chamber 42 having an inverted U-shape and includes barriers 44 alternately attached to its base and roof and terminating in stack 46 through which gases comprising primarily carbon dioxide and water vapor emanate in a cooled state. Air baffle 40 may include chilled water at its base 41 to hasten the cooling of said vapors.

The interior or primary combustion chamber 22 is primarily fabricated of fire brick which can withstand extremely high temperatures. The remaining materials in incinerator 10 are fabricated of conventional materials which can withstand the temperatures to which they are exposed. Tray movement tracks 18 pass through a damper 19 at the entrance 21 to loading chamber 16 to control the amount of air (oxygen) permitted to enter primary combustion chamber 22. The opposite end of tray movement tracks 18 exiting through wall 34 through exit portal 28 may have an optional damper (not shown). The heat currents generated through chamber 24 and the ash residue collected in trays 20 effectively serve to block the entrance of undesired air (oxygen) through said exit portal 28. As trays 20 exit said portal 28 the residual ash is dumped into barrels for cooling.

The principal novel advantage of incinerator 10 is its division of the primary combustion chamber physically into an upper 26 and a lower section 24, and the self-fueling of the said lower section 24 with methane gas from slow-burning materials in the loading chamber 16. The partial separation of the two sections of the primary combustion chamber and the movement of trays of burning waste materials therethrough enables basic combustion of dried materials to take place in the forward section 24 of primary combustion chamber 22, the intense burning of said waste materials, particulate matter and gases in the aft portion of section 24 of chamber 22 and the final complete combustion to occur in the area from the end of lower section 24 to wall 34 with the combustion rising to upper section 26, in which it is completed and any flames extinguished as the remaining gases pass on to chamber 38, the lower 24 and upper 26 sections of primary combustion chamber 22 thus replacing an after-burner. The other point of novelty is that the loading chamber 16, in which materials to be incinerated are stored prior to falling into trays 20, is preheated from the heat of primary combustion chamber 22, causing the waste materials to dry thoroughly, partially ignite in very slow, starved oxygen combustion and generate from said slow and incomplete combustion methane gas or equivalent, which is forced into the primary combustion chamber to fuel the combustion, especially in the upper portion of section 24 thereof. Thus, the requirement of the prior art for an independently fueled after-burner is eliminated.

The utilization of an elongated primary combustion chamber having trays of combustible materials moving slowly therethrough permits a combination of initial, slow-burning, non-turbulent combustion generating gases to fuel a subsequent intense, turbulent fire in the same chamber, thus causing a complete combustion of the gases and particulate matter, with the final combustion taking place near the end where the two sections of the primary chamber do not overlap. The final combustion is forced back through the upper chamber where it is extinguished and the gases forced into collection chamber 38.

A prototype of the incinerator described herein has been constructed, and it has passed inspection by the Department of Environmental Protection of the State of Maine. The development of this incinerator has been in progress for more than 10 years.

I claim:

1. An improved incinerator for complete combustion of waste materials comprising:

a loading hopper for the insertion of waste materials into said incinerator, a loading chute operably connected to said hopper for loading said waste materials from said hopper to said incinerator;

a loading chamber operably connected to said loading chute to receive waste materials for movement into said incinerator;

means to force said waste material from said hopper through said chute and into said loading chamber;

an elongated, inverted U-shaped structure serving as a section of a primary combustion chamber, one end of which opens directly into said loading chamber;

a second elongated, inverted U-shaped structure having a wider vase and greater height than said first structure, but shorter than the first;

said second structure positioned partially over said first structure and having one end wall connecting to said first structure and one full end wall;

said second structure serving as the termination of said primary combustion chamber;

a set of tracks running the length of said loading chamber and said primary combustion chamber, at the base thereof, entering through said loading chamber and exiting through the end wall of said second structure;

trays to move along said tracks to carry waste materials from said loading chamber through said primary combustion chamber;

means to move said trays along said tracks, dampers to control the flow of air at the openings through which said trays enter and exit on said tracks;

a vapor collection chamber in communication with said second U-shaped structure to receive the vapors emanating therefrom;

an air baffle in communication with said collection chamber to filter said vapors, collect any residual particulate matter and cool said vapors;

a stack in communication with the opposite end of said air baffle to permit the flow of vapors into the atmosphere.

2. The improved incinerator of claim 1 wherein said means to force said waste material into said loading chute comprises a hydraulically operated ram device.

3. The improved incinerator of claim 1 wherein the means to move said trays along said tracks comprises a hydraulically operated ram device.

4. The improved incinerator of claim 1 wherein said loading chute is upwardly inclined.

5. The incinerator of claim 1 wherein said trays have overlapping lips to prevent the falling of waste material or ash between them.

6. The improved incinerator of claim 1 wherein initial combustion commences at the base of said loading chamber and continues to intensify along the length of said primary combustion chamber.

7. The improved incinerator of claim 1 wherein said initial combustion at the base of said loading chamber produces flamable gases which serve to fuel the combustion in both the primary and secondary combustion chambers.

* * * * *